United States Patent [19]

Varanese

[11] Patent Number: 4,484,363

[45] Date of Patent: Nov. 27, 1984

[54] COMBINATION HAT AND COOLING DEVICE

[76] Inventor: Teresa E. Varanese, 1555 Mesa Verde E., No. 49-L, Costa Mesa, Calif. 92626

[21] Appl. No.: 554,966

[22] Filed: Nov. 25, 1983

[51] Int. Cl.[3] ..... A42B 1/06

[52] U.S. Cl. ..... 2/209.1; 2/181; 2/181.6; 2/DIG. 6

[58] Field of Search ..... 2/209.1, 181, 181.6, 2/181.2, 181.4, DIG. 11, 7, DIG. 6

[56] References Cited

U.S. PATENT DOCUMENTS

| | | | |
|---|---|---|---|
| 954,708 | 4/1910 | Townsend | 2/181 |
| 1,434,854 | 11/1922 | Stall | 2/181 |
| 2,335,630 | 11/1943 | Bachardy | 2/7 |
| 2,875,447 | 3/1959 | Goldmerstein | 2/171.2 |
| 3,029,438 | 4/1962 | Henschel | 2/181 |
| 3,070,803 | 1/1963 | Slepicka | 2/7 |
| 4,165,542 | 8/1979 | McLaughlin | 2/209.1 |
| 4,237,558 | 1/1980 | Mackenroth | 2/181.4 |

OTHER PUBLICATIONS

"Date Omnipak Hot/Cold Support" #0584-542, Baka Manufacturing Comp., Plainville Mass. 02762, 1982.

Gershman, *Journal of American Medical Association* vol. 168, No. 7, "Self Adhereing Nylon Tapes," p. 980, Oct. 19, 1958.

*Primary Examiner*—Werner H. Schroeder
*Assistant Examiner*—Mary A. Ellis
*Attorney, Agent, or Firm*—Francis X. LoJacono

[57] ABSTRACT

The present invention is directed to a hat in combination with a cooling device which is removably mounted to the front inside portion of the hat, the device including an enclosure defined by an inverted pocket adapted to receive and store a sealed container filled with a coolant, so as to provide a cooling effect to the forehead and the general area of the frontal portion of the wearer's head.

7 Claims, 5 Drawing Figures

FIG. 1
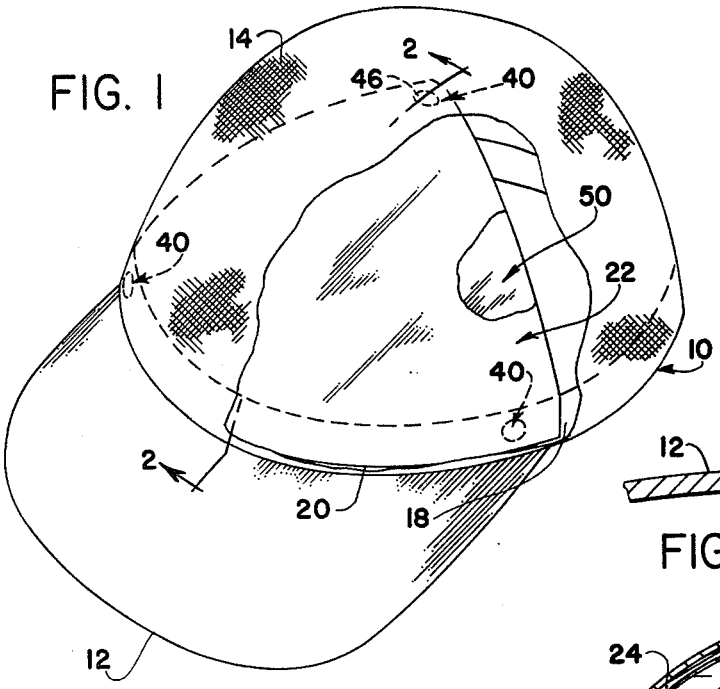
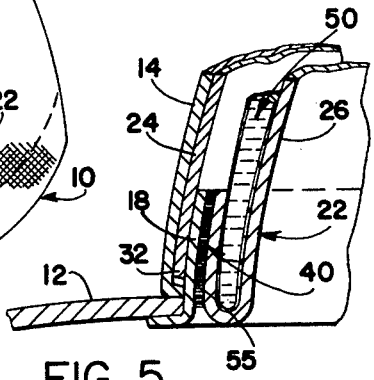
FIG. 5
FIG. 2
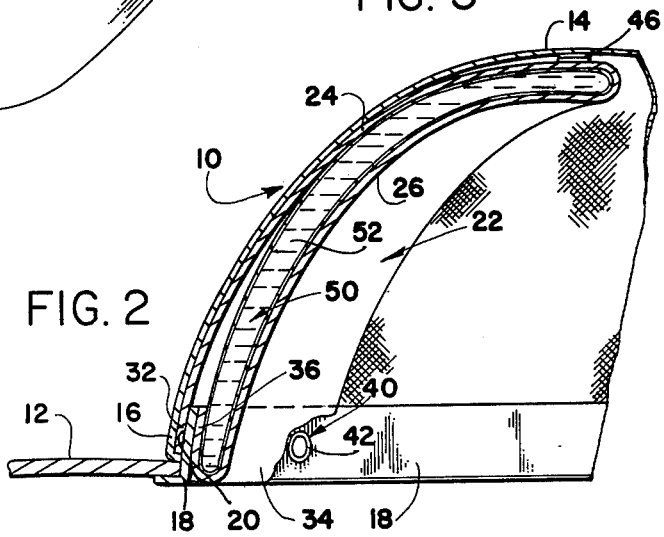
FIG. 3
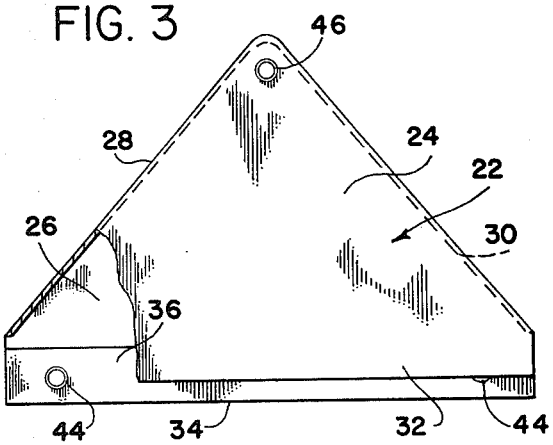
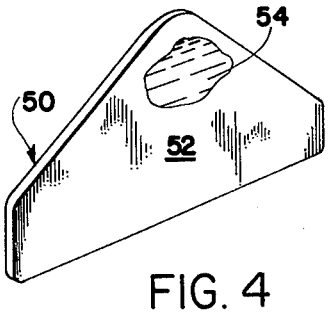
FIG. 4

COMBINATION HAT AND COOLING DEVICE

BACKGROUND OF THE INVENTION

1. Field of the Invention

This invention relates generally to a cooling device designed to cool a part of the anatomy of one's body, and more particularly to a triangularly shaped enclosure that is removably attached within a hat structure so as to be positioned adjacent the forehead of the wearer, whereby a coolant container is received and stored in the enclosure so as to provide a cooling effect to the forehead, or the general area of the frontal portion of the wearer's head.

2. Description of the Prior Art

There is a need to provide a suitable means for reducing body heat while one is taking part in an active sport; or, when an individual is exposed to the sun for long periods of time while attending sporting games or events as a spectator.

As one example of a body-cooling device, one may refer to U.S. Pat. No. 2,335,630 wherein there is disclosed a cooling unit defined by a double-wall vacuum container that is removably mounted in a hat structure. The container is adapted to receive dry ice or other refrigerant material which might evaporate or decompose into a gas, and thus readily escape.

In U.S. Pat. No. 2,875,447 there is disclosed a cooling band which is attached to or made a part of any headgear. The band is formed as an outer, absorbent, evaporator member of thick, porous, fabric material which can be soaked with water or other coolant fluid for evaporation. The band further includes an inner headband comprising a conductive strip of metallic foil to encircle the head and to contact the evaporator member for cooling the conductive strip, as the coolant fluid evaporates from the evaporator member.

U.S. Pat. No. 3,070,803 discloses various hat members, each of which includes a coolant means formed as an integral part thereof. The coolant means is defined by a flexible water-impervious bag which is formed as part of the crown, or is shaped to form the crown, including the side walls and brim member thereof. The bag is provided with an opening which is closed by a removable plug member, thus allowing the bag to receive and store a coolant in the form of a liquid or ice.

There is disclosed in U.S. Pat. No. 3,090,045 another type of thermal head appliance which is designed for holding an ice bag in position on the top of the wearer's head, the bag having an enlarged opening and threaded cap.

Still another type of cooling device is disclosed in U.S. Pat. No. 4,204,543 which relates to an elasticized or adjustable band of cloth material which is to be worn about the peripheral portion of the head, and is formed having a fixed pocket in which is placed a container of frozen liquid or semiliquid material.

All of the above devices have disadvantages in that they either employ ice as the cooling medium or the entire hat device must be placed in a freezer—thus creating additional problems. Also, the head is not fully protected as with the use of the band-type unit.

The present device is particularly suited to be worn as a hat or cap, so that only the forehead and a portion of the frontal area of one's head is affected by the coolant material. This arrangement is more efficient, since it provides the wearer with a coolant that remains in a cold state for longer periods of time, without the need for constant refreezing.

Accordingly, it is an important object to provide a combination hat and cooling means that allows the entire head, if necessary, to be protected by a hat from the sun's radiant heat; while the coolant itself affects basically the forehead and a portion of the upper frontal area of the head. These are the principle parts for effectively reducing body heat, so that it is not necessary to cool other parts of the body as well.

Still another object of the invention is to provide a cooling device for the body which is not necessarily for medical purposes; but is simply a means to establish a comfortable condition when one is exposed to the sun during outdoor activities.

Another object of the present invention is to provide a cooling device wherein a hat is used in combination with a coolant means, and wherein the coolant comprises a triangular enclosure defining an inverted pocket which is removably attached to the front section of the hat. The pocket is adapted to support and store a sealed bag having enclosed therein a refreezable liquid or semiliquid material, whereby the bag can be readily removed from the pocket and placed in a freezer for refreezing the coolant so as to be ready for use again when needed. Thus, it is not necessary for the hat to be placed with the coolant bag during the process of refreezing.

A further object of the invention is to provide a cooling device of this type wherein the pocket and coolant means may be separated from the hat portion and used for a variety of applications, such as applying the coolant to various parts of the body for medical purposes, and wherein the hat can be used alone.

It is a further object of the invention to provide a cooling device of this character that is simple in design, is easy to use and maintain, and is relatively inexpensive to manufacture.

The characteristics and advantages of the invention are further sufficiently referred to in connection with the accompanying drawings, which represent one embodiment. After considering this example, skilled persons will understand that variations may be made without departing from the principels disclosed; and I contemplate the employment of any structures, arrangements or modes of operation that are properly within the scope the appended claims.

BRIEF DESCRIPTION OF THE DRAWINGS

Referring more particularly to the accompanying drawings, which are for illustrative purposes only:

FIG. 1 is a pictorial view of a hat having the front portion thereof broken away, showing the placement of the removable pocket in which is stored the coolant material;

FIG. 2 is a cross-sectional view of the front portion of the hat taken substantially along line 2—2 of FIG. 1;

FIG. 3 is a front-elevational view of the enclosure member that defines a removable pocket;

FIG. 4 is a perspective view of the sealed coolant bag that is adapted to be received and stored in the enclosure member of FIG. 3; and FIG. 5 is an enlarged cross-sectional view of an alternative securing means positioned between the headband of the hat and the enclosure member.

DESCRIPTION OF THE PREFERRED EMBODIMENT

Referring to the drawing and more particularly to FIGS. 1 and 2, there is shown a hat having a design of a cap, generally indicated at 10. The hat may be of any desired shape; however, a cap 10 having a visor 12 is the typical type of head-gear worn for protection from the sun by those participating in outdoor activities such as when playing or watching sporting games, or while jogging, gardening, etc.

Hat 10 further includes a crown member 14 which may be in any suitable configuration. The crown can be formed to cover only the front and upper portion of the wearer's head in accordance with the well known design of most caps. Thus, it is important to note that the present invention is associated with the front section of the cap which is formed from a suitable fabric, and has a visor 12 attached to the lower peripheral edge 16 thereof. Also, as commonly provided with a hat or cap, there is attached to the peripheral edge a headband member 18 which engages about the head of the wearer. The headband is attached to crown 14 so as to provide an inner annular recess 20 to receive a portion of an enclosure means, generally designated at 22 and illustrated in FIG. 3.

Enclosure means 22 defines a pocket having a generally triangular configuration and made preferably from a soft fabric. The pocket is constructed to include a front panel 24 and a rear panel 26, the panels being integrally attached along their inclined edges 28 and 30. However, the base portions of the panels are not attached, thereby providing an opening for the pocket. The lower base portion of the front panel forms a longitudinal lip 32, as seen in FIGS. 2 and 5, which is formed to be received in recess 20 between the lower front peripheral edge 16 of crown 14 and the headband 18. The rear or inner panel 26 also has a free base portion 34 which does not project below the headband when pocket 32 is mounted in the hat. In addition, free base portion 34 is formed with a folded flange member 36.

Interposed between headband 18 and flange 36 is a means to secure the pocket 22 to the front inner section of the hat. Various simple fastening means 40 can be readily employed. As an example, FIGS. 1, 2 and 3 illustrate the use of simple snap fasteners which can be of any suitable type, one member 42 of each fastener being mounted to the headband and the opposite cooperating fastener member 44 being mounted to flange member 36. Accordingly, due to the triangular configuration of the enclosure 22, two snap fasteners are used along the base and matching headband; while a third fastener is provided at the apex of the triangularly shaped pocket or enclosure. The third fastener allows the apex of the pocket to be supported in the crown, so as to be positioned above the wearer's forehead, thus causing the pocket to curve and fit the arcuate configuration of the hat's crown.

The coolant means, designated at 50 and illustrated in FIG. 4, has the same general triangular configuration as that of pocket 22, whereby the coolant is readily supported and stored therein, as seen in FIGS. 1 and 2. The coolant means comprises a sealed bag or container 52 formed from a water-impermeable material, such as a sheet of thin pliable plastic. The bag or container 52 is filled with a liquid or semiliquid gel-like substance 54 which is hermetically sealed within the container at the time of manufacture. Such a coolant means is produced by the 3M Company and is usually employed in a medical application. This particular coolant liquid will not completely freeze under normal freezer conditions and temperatures. Thus, when subjected to a freezing temperature of at least 32° F., the substance will take the form of a firm yet pliable thixotropic slush that will not freeze to a totally hard state as with ice. Thus, the substance together with the container can readily conform to the proper configuration within pocket 22, as seen in FIGS. 1 and 2.

Before inserting the container 52, pocket 22 is first separated from hat 10 and then the frozen container is placed inside the pocket, with the flange 36 overlapping the base of the container. After the container is inserted into the pocket or enclosure, the pocket is again positioned within the inner front section of hat 10 and is secured therein by the snap fasteners, or other suitable securing means. FIG. 5 is a cross-sectional view illustrating the use of a "Velcro" (trademark) material 55 as a securing or fastening means, rather than snap fasteners.

As will be obvious to one skilled in the art, many modifications may be made in the apparatus of the invention as herein described which are still within the spirit and scope of the invention. Therefore, the only limitations to be placed on the scope thereof are those which are expressed in the following claims.

I claim:

1. A hat in combination with a coolant means, comprising:

a hat having at least a front crown section to cover the forehead and the frontal portion of the head of an individual;

an enclosure defining an inverted pocket formed having a triangular configuration, the apex thereof being secured to the upper portion of said front crown section, and the base portion thereof in which said opening is disposed being secured to the lower peripheral edge of said hat;

a coolant means containing a liquid adapted to be freezable to a thixotropic and pliable state, wherein said coolant means is shaped to be received and stored in said pocket; and means for removably securing said pocket to said front section of said hat, said securing means being arranged to cause said pocket and said coolant means therein to conform to the configuration of said front section of said hat, whereby said coolant means is positioned adjacent said forehead and said frontal portion of said individual's head when said hat is worn.

2. The combination as recited in claim 1, wherein said pocket is formed from a cloth material having a front panel and a rear panel, said front panel having a longitudinal lip member and said rear panel including means for supporting said coolant in said pocket.

3. The combination as recited in claim 2, wherein said supporting means comprises an inwardly folded longitudinal flange member formed within said opening of said pocket.

4. The combination as recited in claim 3, wherein said securing means is interposed between said apex of said triangular pocket and the upper portion of said front crown section, and between said longitudinal flange member of said rear panel and the lower portion of said front crown section.

5. The combination as recited in claim 4, wherein said securing means comprises a plurality of snap fasteners.

6. The combination as recited in claim 4, wherein said securing means comprises a "Velcro" material.

7. The combination as recited in claim 4, wherein said coolant means comprises a sealed container formed from a thin, pliable, water-impermeable material, said container being formed having a substantially triangular configuration.

* * * * *